United States Patent [19]

Pelton

[11] 4,057,252

[45] Nov. 8, 1977

[54] BALL GAME WITH X-FRAMED BACKSTOP

[76] Inventor: Raymond Lionel Pelton, 15420 Olde Highway 80, Space 186, El Cajon, Calif. 92021

[21] Appl. No.: 682,580

[22] Filed: May 3, 1976

[51] Int. Cl.[2] ..... A63B 53/08; A63B 63/04; A63B 67/02

[52] U.S. Cl. ..... 273/101; 273/105 R; 273/168; 273/102 S; 273/181 A

[58] Field of Search ..... 273/168, 102.4, 103, 273/105 R, 102 S, 181 R, 181 A, 176 F, 176 AB, 176 AA, 101; 108/118

[56] References Cited

U.S. PATENT DOCUMENTS

| | | | |
|---|---|---|---|
| 920,907 | 5/1909 | Bolton | 273/181 F |
| 921,366 | 5/1909 | Conolly | 273/105 R |
| 1,426,160 | 1/1922 | Driver | 108/118 |
| 1,923,152 | 8/1933 | Kohn | 273/181 A |
| 2,220,492 | 11/1940 | Piesco | 273/105 R |
| 2,336,405 | 12/1943 | Kent | 273/168 |
| 3,467,388 | 9/1969 | Weiler | 273/105 R |
| 3,843,136 | 10/1974 | Buenzle | 273/176 F |

FOREIGN PATENT DOCUMENTS

| | | | |
|---|---|---|---|
| 887 | 2/1931 | Australia | 273/105 |
| 17,370 | 1/1913 | Denmark | 108/118 |

*Primary Examiner*—Richard C. Pinkham
*Assistant Examiner*—Lawrence E. Anderson
*Attorney, Agent, or Firm*—Brown & Martin

[57] ABSTRACT

A collapsible backstop supports an upwardly opening net. Ball tees are positioned by a runner attached to the backstop. A mallet with faces having differing inclinations is utilized to loft a ball resting on one of the ball tees into the net.

9 Claims, 5 Drawing Figures

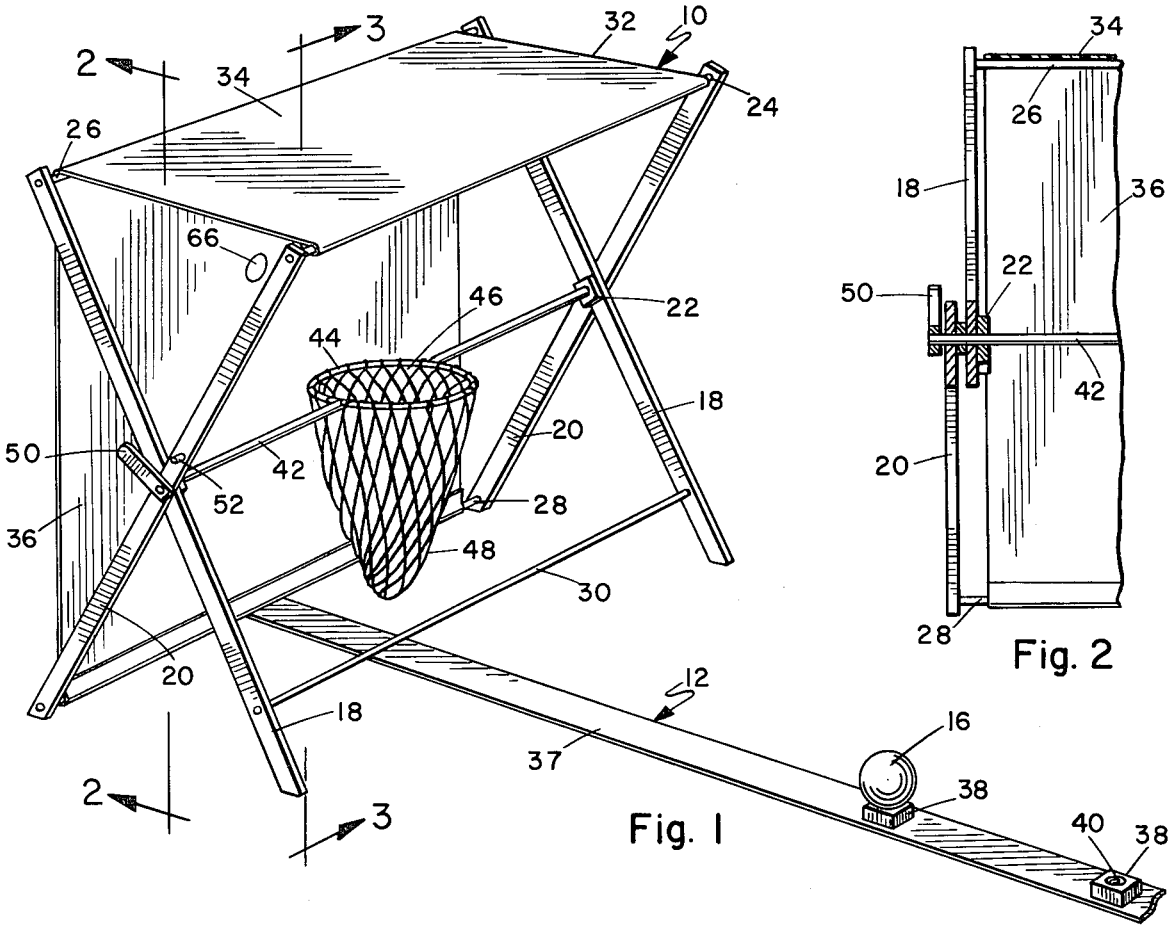
Fig. 1
Fig. 2
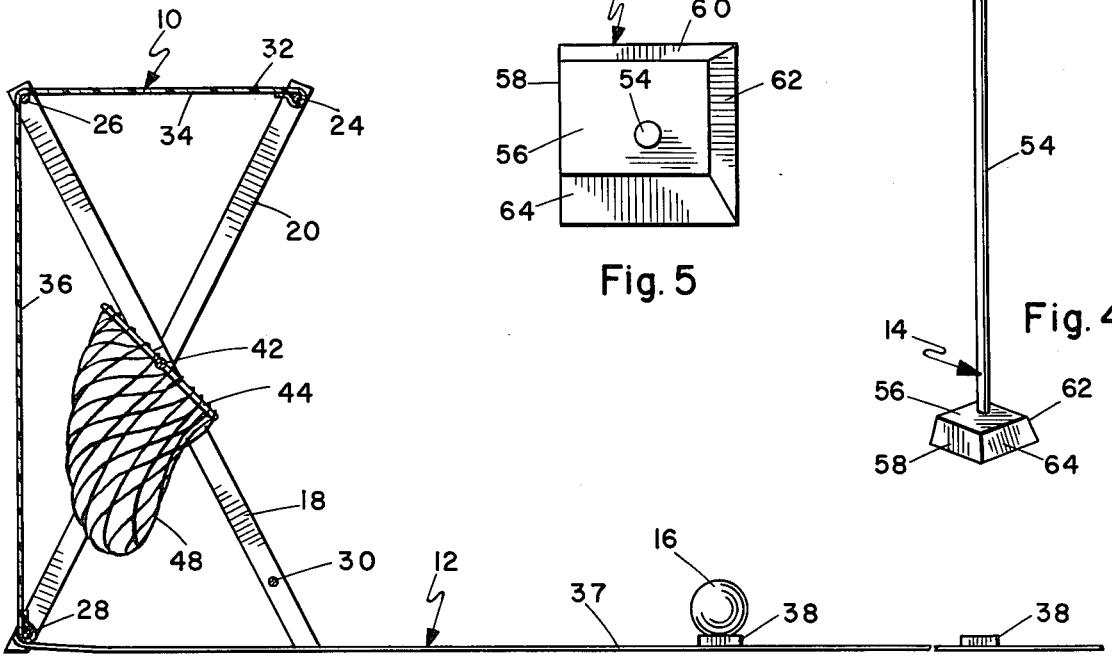
Fig. 3
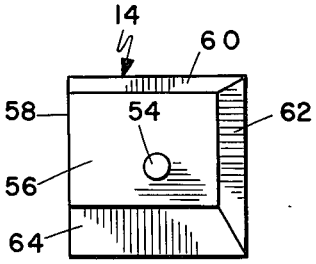
Fig. 5
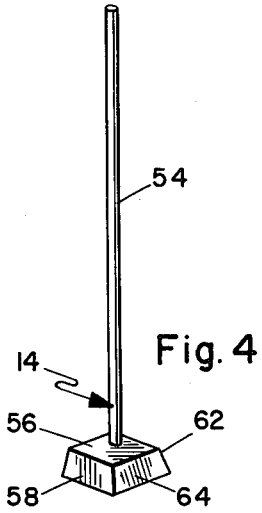
Fig. 4

BALL GAME WITH X-FRAMED BACKSTOP

BACKGROUND OF THE INVENTION

A large number of games are marketed for indoor use. The largest single quantity of such games are generally categorized as board games. Typically such games have a strong or predominate element of chance and in any event, do not involve physical exertion.

Various indoor games have been proposed involving skill and physical exertion whereby a ball or similar object is thrown, shot or otherwise projected toward a target. Where such games involve rolling a ball along the carpet or other flooring, they are subject to the uncontrolled irregularities in such flooring and therefore, cannot be played with consistent results. Similar games that involve throwing or otherwise projecting a ball through an opening in a backstop result in a high velocity for the projected object with the resultant danger that the ball may strike and damage other objects in the room. Such games therefore cannot be played in most rooms.

Therefore, it is desirable to have an indoor ball game which requires skill in projecting the ball to a target, but results in relatively low ball velocities so as to minimize or eliminate damage to the other objects in the room. Such a game is particularly desirable where it may be easily folded to a relatively small size for storage.

SUMMARY OF THE INVENTION

An exemplary embodiment of the invention utilizes a backstop comprises of crossed folding frame legs which pivot about a central pivot bearing from a stowed, aligned orientation to an X-shaped, deployed orientation. Spaced pairs of the crossed legs are employed and are connected by parallel transverse rods at the upper and lower ends of the legs. A curtain of flexible sheet material is received over the upper forward transverse rod, passes over the upper rearward transverse rod and is secured over the lower rearward transverse rod. Opening of the crossed legs stretches the curtain material taut over the transverse rods for purposes to become more apparent hereinafter. The curtain serves as a limit stop on the extent to which the crossed legs may open. With the curtain stretched taut, the curtain forms a top and bottom panel surface against which a ball may strike and thereby be deflected away from striking other objects in the room.

A net is suspended below the top panel and in front of the rear panel, and arranged with its open mouth facing upwardly. The net is carried on a net ring which is in turn carried on a pivot shaft through the pivot bearing of the crossed legs. The rotation of the pivot shaft is limited so that the net ring and associated net may be rotated between operative positions where the net ring is horizontal and therefore, the mouth of the net faced directly upwardly, and to a position whereby the net ring is at substantially 45° to the horizontal, so that the mouth of the net faces upwardly and forwardly.

A ball positioning runner is attached to the frame and extends in front of the frame. Ball tees are secured to the runner at spaced intervals so that a ball positioned on the ball tee is directly in front of the backstop and net and at a predetermined distance from the net.

The mallet for use with the invention incorporates a generally upright shaft handle and a striking head with a plurality of striking faces. The inclination of the striking faces varies from the vertical through 3° of inclination. The mallet is swung in an arc in such a manner that the club head is travelling generally horizontally at the moment of impact with the ball. By a combination of variations on the inclination of the club head at impact, the selection of the particular inclined face, and the velocity of the club head, the player may obtain a regulated degree of loft to the ball. By regulating the loft of the ball and the distance which the ball travels, it is possible to cause the ball to pass directly through the net ring and into the net. As an alternative method of play with the net ring in the horizontal position, the rear panel of the baskstop forms a backboard for deflecting a ball striking the panel back toward and into the net.

It is therefore an object of the invention to provide a new and improved indoor ball game.

It is another object of the invention to provide a new and improved indoor ball game with a folding backstop.

It is another object of the invention to provide a new and improved indoor ball game utilizing a sheet material backstop with multiple functions.

It is another object of the invention to provide a new and improved indoor ball game adjustable to vary the skill required.

It is another object of the invention to provide a new and improved indoor ball game with a mimimum number of parts.

It is another object of the invention to provide a new and improved indoor ball game that minimizes the potential for damage to other objects in a room.

It is another object of the invention to provide a new and improved indoor ball game that is easily unfolded and deployed.

Other objects and many attendant advantages of the invention will become apparent upon a reading of the following detailed description together with the drawings in which like reference numerals refer to like parts throughout and in which:

BRIEF DESCRIPTION OF THE DRAWINGS

FIG. 1 is a perspective view of the game set up for play.

FIG. 2 is a sectional view taken on line 2—2 of FIG. 1.

FIG. 3 is a sectional view taken on line 3—3 of FIG. 1, with the net in a different position.

FIG. 4 is a perspective view of the mallet used for lofting the ball.

FIG. 5 is an enlarged top plan view of the mallet showing the multiple inclined faces.

DETAILED DESCRIPTION OF THE DRAWINGS

Referring now to the figures, the invention is shown to incorporate a backstop 10, ball tee positioning strip 12, mallet 14 and ball 16.

The backstop 10 incorporates crossed frame legs 18 and 20 forming two pairs of generally X-shaped frame members in their deployed position as illustrated. The pairs of legs are joined together at pivot bearings 22. Generally adjacent to the ends of the legs 18 and 20, the parallel transverse rods 24, 26, 28 and 30 are secured. Transverse rod 24 at the upper forward end of leg 20 receives one end of a curtain 32. The curtain 32 is secured around the transverse rod 24 and passes over transverse rod 26 and is secured over the transverse rod 28. The material 32 is flexible for folding the backstop 10 but is substantially fixed in length so that the degree to which the legs 18 and 20 may be spread apart is limited by the length of the material 32. Thus when the legs 18 and 20 are spread apart to their maximum extent the material 32 is stretched taut and limits further extension of the legs. In the taut and fully extended deployed configuration as illustrated in FIG. 1, the material 32 forms a top panel 34 and a back panel 36. The back panel 36 is provided with a target indicator 66 for purposes that will be described more fully hereinafter.

A net 48 is supported below the top panel 34 and in front of the rear panel 36 on a pivot shaft 42. The pivot shaft 42 is received in the bearings 22 and carries a net ring 44. The net 48 is deployed over the net ring 44 so as to form an opened mouth 46. The orientation of the net is controlled by a handle 50 affixed to the terminal portion of pivot rod 42. In its operational orientation, the net ring is positioned horizontally as in FIG. 1, or rotated with handle 50 against stop 52, so that the mouth 46 opens upwardly and forwardly at a 45° angle as in FIG. 3. For folding, the net ring 44 is rotated oppositely from the horizontal so that the net ring becomes vertical and permits the frame to collapse to a minimum dimension. The tee positioning strip 12 incorporates a runner 37 of flexible sheet material, such as fabric, having a plurality of tee blocks 38 secured thereto at spaced points therealong. The tee blocks have an upper recess 40 for receiving the ball 16. The runner 37 is deployed by stretching it to its full extent in front of the net 48. When so deployed the first tee block 38 is speced by a predetermined distance from the net 48. Each succeeding tee block 38 is spaced an equal incremental distance from the backstop 10. In the preferred embodiment of the invention, there are seven tee blocks 38.

The mallet 14 incorporates a vertically upright handle 54 and a striking head 56. There are four striking surfaces on the head 56 including the vertical surface 58 and inclined surfaces 60, 62 and 64. As will be apparent, striking the ball 16 with the vertical face 58 will produce the least loft of the ball, whereas striking the ball with the surface 64 will produce a maximum loft of the ball. Therefore, the player must select the striking velocity utilized together with the inclination of the mallet head as it strikes the ball and the selected striking surface, in order to create a correct loft on the ball, so that the ball will pass through the net ring 44, and into the net 48. The ball 16 is preferably of a light weight hollow plastic material.

The game would normally be stored when not in use with the legs 18 and 20 in approximate alignment, the net ring 44 turned to a vertical orientation, and the runner 37 rolled and stowed in the net 48. When collapsed in this manner, the game is not substantially thicker than the width of a single one of the legs 18 or 20 and therefore, may be conveniently stored in a closet without detracting from other uses of the closet.

The game is rapidly deployed by rotating the legs 18 and 20 relative to one another to cause the legs to assume a crossed X-shaped configuration stretching the curtain 32 into back and top panels. The runner 37 is then deployed in front of the backstop and the game is ready for use. According to the preferred use of the apparatus, the players first select between the horizontal and 45° orientation for the net ring 44. The 45° inclination provides for more direct shots and requires less loft whereas the horizontal orientation makes rebound shots possible. The ball 16 is placed on the tee block 38 nearest to the backstop 10. The player grasps the mallet 14 by the upright handle 54 and rotates the mallet head so that a selected striking surface is perpendicular to the intended line of flight. The player then attempts to strike the ball 16 and loft the ball through the net ring 44. Normally three attempts are permitted at each of the seven tee blocks 38 for a total of 21 possible points. For use with the horizontal orientation of the net ring 44, the target indicator 66 provides an indication of the approximate point of the back section 36 where a shot will be deflected from the back section 36 and rebounded into the net 48. Since in all forms of the game the ball must be lofted, relatively slow flight of the ball is necessary. Thus, the game protects the other objects in the room from damage both by the provision of an effective backstop 10, by the use of a light weight ball 16 and by the inherent requirement of the game for slow flight balls.

Having described my invention, I now claim:

1. An indoor ball game comprising:

a frame, a resilient sheet material received over said frame forming substantially a planar back panel and a top panel, said frame having a generally opened front, a net supported in front of said back panel and under said top panel, said net having an open mouth facing upwardly, said frame comprising spaced pairs of legs joined near their centers to form X-shaped frame members in their deployed orientation, a plurality of transverse rods, said X-shaped frame members being joined by said plurality of transverse rods extending between said frame members near the upper and lower ends of the corresponding legs, said sheet material being secured to the upper forward transverse rod, passing over the upper rearward transverse rod and being secured to the lower rearward tranverse rod.

2. The game according to claim 1 wherein:

said net is received over a net ring, said net ring is carried on said frame.

3. The game according to claim 2 wherein:

said net ring is carried on said frame for pivotal movement between horizontal and 45° forwardly inclined orientations.

4. The game according to claim 1 wherein:

said net is carried on a net ring, said net ring is pivotally mounted on said frame, said leg members and said net ring have a common pivot point.

5. The game according to claim 1 further including:

means for positioning ball tees at spaced intervals from said frame.

6. The game according to claim 5 wherein:

said means for positiioning spaced tees comprises a runner of flexible sheet material having ball tees secured to said runner at spaced intervals.

7. The game according to claim 6 wherein:

said ball tees comprise a tee block having an upper recess.

8. The game according to claim 1 further including:

a striking mallet having a plurality of striking faces with different inclinations.

9. An indoor ball game comprising:

a frame, resilient sheet material received over said frame forming substantially a planar back panel and a top panel, said frame having a generally opened front, a net supported in front of said back panel and under said top panel, said net having an open mouth facing upwardly, a striking mallet having a plurality of striking faces with different inclinations, an elongated runner of sheet material having a plurality of ball tees secured thereto at spaced points therealong, said frame comprising spaced pairs of legs joined together near their centers to form in their deployed position substantially X-shaped frame members, said frame legs being joined by a pivot rod extending between said X-shaped frame members, said pivot rod mounting at the central portion thereof.

a net ring, said net being deployed over said net ring, said legs having transverse rods secured near the ends thereof, said sheet material being secured over the upper forward transverse rod, received over the upper rear transverse rod and secured to the lower rear transverse rod.

* * * * *